US007073441B2

(12) United States Patent
Tamura et al.

(10) Patent No.: US 7,073,441 B2
(45) Date of Patent: Jul. 11, 2006

(54) IMAGE RECORDING APPARATUS

(75) Inventors: Toshio Tamura, Kyoto (JP); Toru Kawada, Kyoto (JP); Hirohisa Tanaka, Kyoto (JP); Katsuji Oku, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/923,852

(22) Filed: Aug. 24, 2004

(65) Prior Publication Data

US 2005/0056168 A1 Mar. 17, 2005

(30) Foreign Application Priority Data

Aug. 28, 2003 (JP) ..... 2003-304288

(51) Int. Cl.
*B41F 27/12* (2006.01)

(52) U.S. Cl. ..... 101/477; 101/401.1

(58) Field of Classification Search ..... 101/3.1, 101/4–6, 26, 22–24, 35, 36, 486, 485, 477, 101/401.1, DIG. 36
See application file for complete search history.

(56) References Cited

U.S. PATENT DOCUMENTS 4,534,248 A * 8/1985 Andersson ..... 83/24
4,840,121 A * 6/1989 Szczesniak ..... 101/415.1
5,394,614 A * 3/1995 Lindner et al. ..... 33/621
5,782,179 A * 7/1998 Kagawa et al. ..... 101/128.4
5,842,397 A 12/1998 Shimizu et al. ..... 83/54
5,896,815 A 4/1999 Sickert ..... 107/401.1
6,213,020 B1 4/2001 Kawada et al. ..... 101/486
6,481,349 B1 * 11/2002 Jehring et al. ..... 101/415.1
2003/0037688 A1 * 2/2003 Fukui ..... 101/477
2003/0127004 A1 7/2003 Kitawaki et al. ..... 101/382.1
2004/0040456 A1 * 3/2004 Wolber ..... 101/401.1

FOREIGN PATENT DOCUMENTS

| | | |
|---|---|---|
| EP | 0 700 761 A1 | 3/1996 |
| EP | 1 256 845 A2 | 11/2002 |
| JP | 09-152707 | 6/1997 |
| JP | 11-048195 | 2/1999 |
| JP | 2000-56482 A | 2/2000 |

* cited by examiner

*Primary Examiner*—Anthony H. Nguyen
(74) *Attorney, Agent, or Firm*—McDermott Will & Emery LLP

(57) ABSTRACT

A punch unit includes punch blocks supported by an arm through support plates. The arm has, arranged thereon, a motor for rotating a drive rod, a detector for detecting rotation angles of the drive rod, and a sensor for detecting a forward end of a recording material. The punch unit is movable by a moving mechanism including support members arranged at opposite ends of the arm, slide shafts and ball screws connected to the support members, and a pulse motor for driving the ball screws through a synchronous belt and synchronous pulleys.

12 Claims, 16 Drawing Sheets

IMAGE RECORDING APPARATUS

BACKGROUND OF THE INVENTION

1. Field of the Invention

This invention relates to an image recording apparatus for recording an image by emitting light beams to a recording material mounted on a recording drum.

2. Description of the Related Art

When printing in four color inks of yellow (Y), magenta (M), cyan (C) and black (K), for example, the same positional relationship must be maintained, for each of the YMCK colors, between a positioning bore for the printing machine used in positioning a printing plate, and an image recorded on the printing plate. The term "positioning bore for the printing machine" used in this specification includes a positioning bore used in placing the printing plate on a plate cylinder of the printing machine, and also a punch bore such as a positioning bore used in placing the printing plate on a puncher for forming a further punch bore in the printing plate.

In a method proposed in U.S. Pat. No. 6,213,020 (hereinafter called "the first method"), a positioning bore for positioning a recording material on a recording drum and a positioning bore for the printing machine are formed almost simultaneously in the recording material before attachment to the recording drum, and the recording material is positioned on the recording drum by using the former. Specifically, when attaching the recording material to the recording drum, the recording material is positioned relative to the recording drum by placing the positioning bore formed at an end of the recording material in contact with a positioning pin, and then the recording material is fixed to the recording drum.

In a method proposed in Japanese Unexamined Patent Publication No. 1997-152707 (hereinafter called "the second method"), a punch unit is disposed on a surface of a recording drum, and after attaching a recording material peripherally of the recording drum, the punch unit is used to form a positioning bore for the printing machine in the recording material for use in positioning a printing plate.

In the first method described above, the recording material is positioned on the recording drum by placing the positioning bore formed at an end of the recording material in contact with positioning pin. This method has a drawback that, where the recording material is a soft material, a deformation of the recording material makes it impossible to position the recording material accurately on the recording drum. This results in an inaccurate positional relationship between the positioning bore and a recorded image.

On the other hand, the second method described above requires the punch unit to be attached peripherally of the recording drum. When the recording drum is rotated at high speed, the weight of the punch unit will make it difficult to rotate the recording drum with high accuracy unless the weight balance of the entire recording drum is adjusted accurately. When the punch unit is customized, it is necessary to perform an adjustment of the weight balance of the recording drum again, and hence a drawback of the punch unit not being easy to customize.

SUMMARY OF THE INVENTION

The object of this invention, therefore, is to provide an image recording apparatus capable of accurately maintaining a positional relationship between an image recorded on a recording material and a positioning bore, and enabling a simple balance adjustment of a recording drum.

The above object is fulfilled, according to this invention, by an image recording apparatus comprising:

a recording drum having a peripheral surface defining a recess extending axially of the drum;

an attaching mechanism for attaching a recording material to the peripheral surface of the recording drum, with a forward end of the recording material located over the recess;

a rotating mechanism for rotating the recording drum;

a recording head for recording an image on the recording material by moving axially of the recording drum synchronously with rotation of the recording drum, and emitting light beams to the recording material mounted peripherally of the recording drum;

a punch unit having a die defining a slit, and a punch movable inside the die for punching a positioning bore in the recording material inserted into the slit; and a moving mechanism for moving the punch unit between a standby position separated from the recording drum, and a punching position where the forward end of the recording material mounted peripherally of the recording drum is inserted into the slit formed in the die.

With this image recording apparatus, the accuracy of the positional relationship between a punch bore formed by the punch unit and a recorded image may be improved without positioning the recording material on the peripheral surface of the recording drum with high precision. Moreover, the punch unit need not be attached to the recording drum since the moving mechanism is provided for moving the punch unit between a standby position separated from the recording drum and a punching position. Thus, there is no need to adjust the weight balance of the recording drum when customizing the punch unit.

In a preferred embodiment, the apparatus further comprises a sensor for detecting a position of the forward end of the recording material mounted peripherally of the recording drum.

The apparatus may further comprise suction bores formed in the peripheral surface of the recording drum, and an exhaust mechanism connected to the suction bores through an air duct for drawing air through the air duct, thereby holding the recording material on the peripheral surface of the recording drum by suction. When discharging the recording material from the peripheral surface of the recording drum, the exhaust mechanism may be reversed to feed air into the air duct.

The apparatus may further comprise a craw mechanism for separating the recording material from the peripheral surface of the recording drum when discharging the recording material from the peripheral surface of the recording drum.

In another preferred embodiment, the apparatus further comprise a sensor for detecting a position of the forward end of the recording material mounted peripherally of the recording drum, and a control device for controlling an amount of movement of the punch unit caused by the moving mechanism according to the position of the forward end of the recording material detected by the sensor, and adjusting an image recording start position of the recording head based on the position of the forward end of the recording material detected by the sensor.

The sensor may be attached to the punch unit for detecting the position of the forward end of the recording material during movement of the punch unit.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
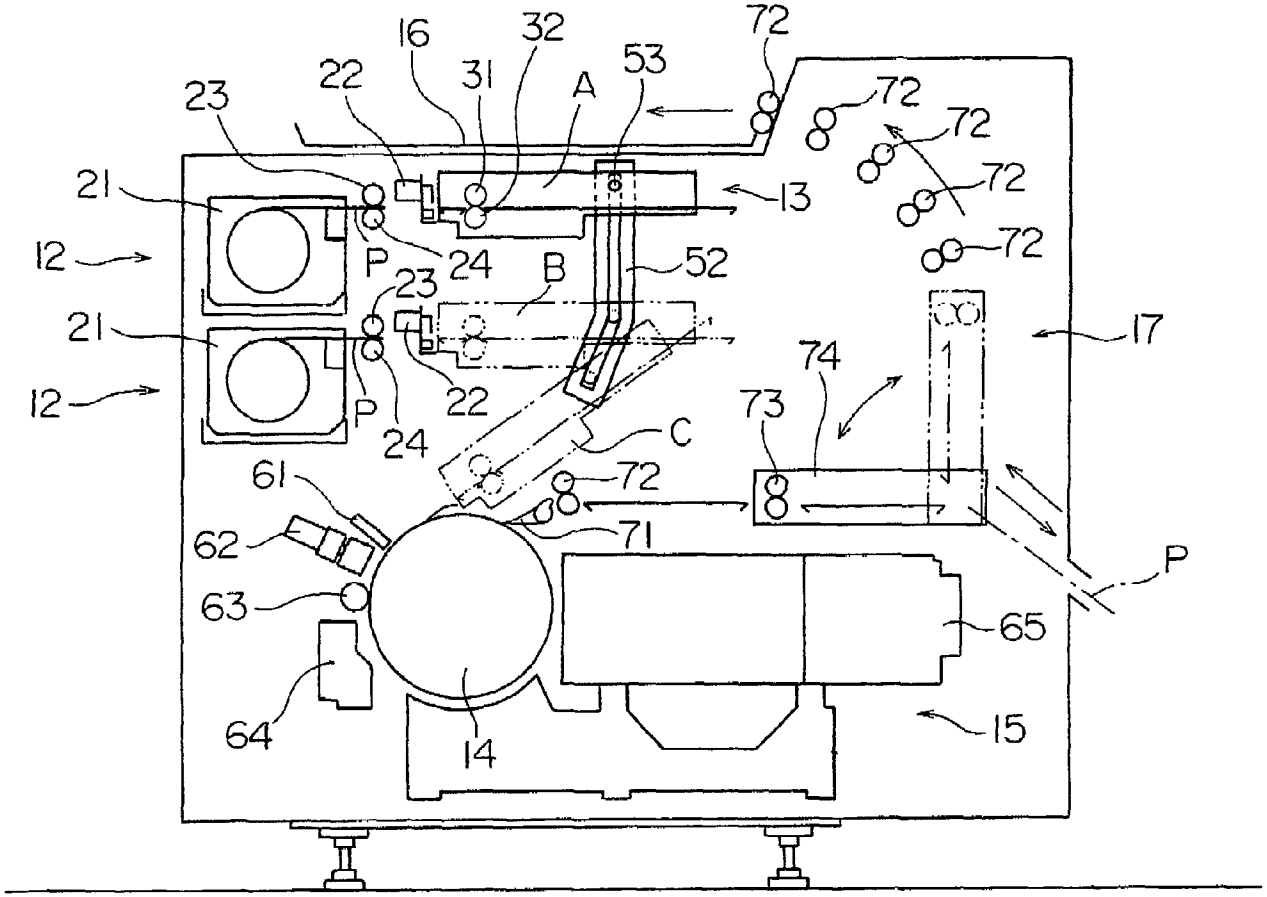
FIG. 1 is a schematic view of an image recording apparatus according to this invention.

An embodiment of this invention will be described hereinafter with reference to the drawings. FIG. 1 is a schematic view of an image recording apparatus according to this invention.

The image recording apparatus includes two recording material storage sections 12 arranged vertically, a recording material transport device 13 used for transporting a recording material P, a lift mechanism for raising and lowering the transport device 13, a tilt mechanism having a cam 52 and a cam follower 53 for tilting the transport device 13, a recording drum 14 for supporting the recording material P mounted peripherally thereof, an image recorder 15 for recording an image on the recording material P mounted on the recording drum 14, and a discharge mechanism 17 for discharging the recording material P having the image recorded thereon to a discharge tray 16.

Each of the recording material storage sections 12 includes a magazine 21 storing an elongate recording material P in roll form therein, and a pair of take-out rollers 23 and 24 for taking the recording material P out of the magazine 21.

The recording material transport device 13 supports, in a horizontal state, the recording material P drawn from either recording material storage section 12, and transports the recording material P toward the recording drum 14 in a switchback mode. The transport device 13 includes a pair of transport rollers 31 and 32 for transporting the recording material P, and a cutter 22 for cutting the elongate recording material P. This recording material transport device 13 is movable, by action of the lift mechanism and tilt mechanism, between a position, referenced A in FIG. 1, opposed to the upper recording material storage section 12, a position referenced B opposed to the lower recording material storage section 12, and a position referenced C opposed to the recording drum 14.

Arranged in positions opposed to outer peripheries of the recording drum 14 are a mechanism 61 for opening and closing forward end clamps that clamp a forward end of recording material P mounted on the recording drum 14, a mechanism 62 for attaching and detaching rear end clamps to/from the recording drum 14 that fix a rear end of recording material P to the recording drum 14, a squeeze roller 63 and a punch mechanism 64 which is a characterizing feature of this invention.

The image recorder 15 for recording an image on the recording material P mounted on the recording drum 14 includes a recording head 65, and a moving mechanism for moving the recording head 65 axially of the recording drum 14 (in a direction perpendicular to the plane of FIG. 1: secondary scanning direction). With the recording drum 14 rotated at high speed in a primary scanning direction and the recording head 65 moved axially of the recording drum 14, the image recorder 15 records an image by emitting laser beams, for example, to the recording material P.

The recording head 65 is moved in the secondary scanning direction by a motor, not shown, synchronously with the rotation of the recording drum 14. The recording head 65 emits laser beams to the recording material P with the rotation of the recording drum 14, in accordance with primary scan position information received from an encoder 131, described hereinafter, and indicating rotation angles of the recording drum 14. Thus, the image recorder 15 can record on the recording material P an image having position reproducibility in relation to the peripheral surface of the recording drum 14.

The discharge mechanism 17 for discharging the recording material P after an image recording step to the discharge tray 16 includes claws 71 for separating the recording material P from the peripheral surface of the recording drum 14, a plurality of transport roller pairs 72 and a direction change member 74. The direction change member 74 has a transport roller pair 73 disposed at one end thereof, and is movable from a position shown in solid lines to a position shown in two-dot chain lines in FIG. 1, thereby changing the moving direction of the recording material P in a switchback mode. Thus, the discharge mechanism 17 removes the recording material P with an image recorded thereon from the peripheral surface of the recording drum 14 and transports the recording material P to the discharge tray 16.

Figure 2:
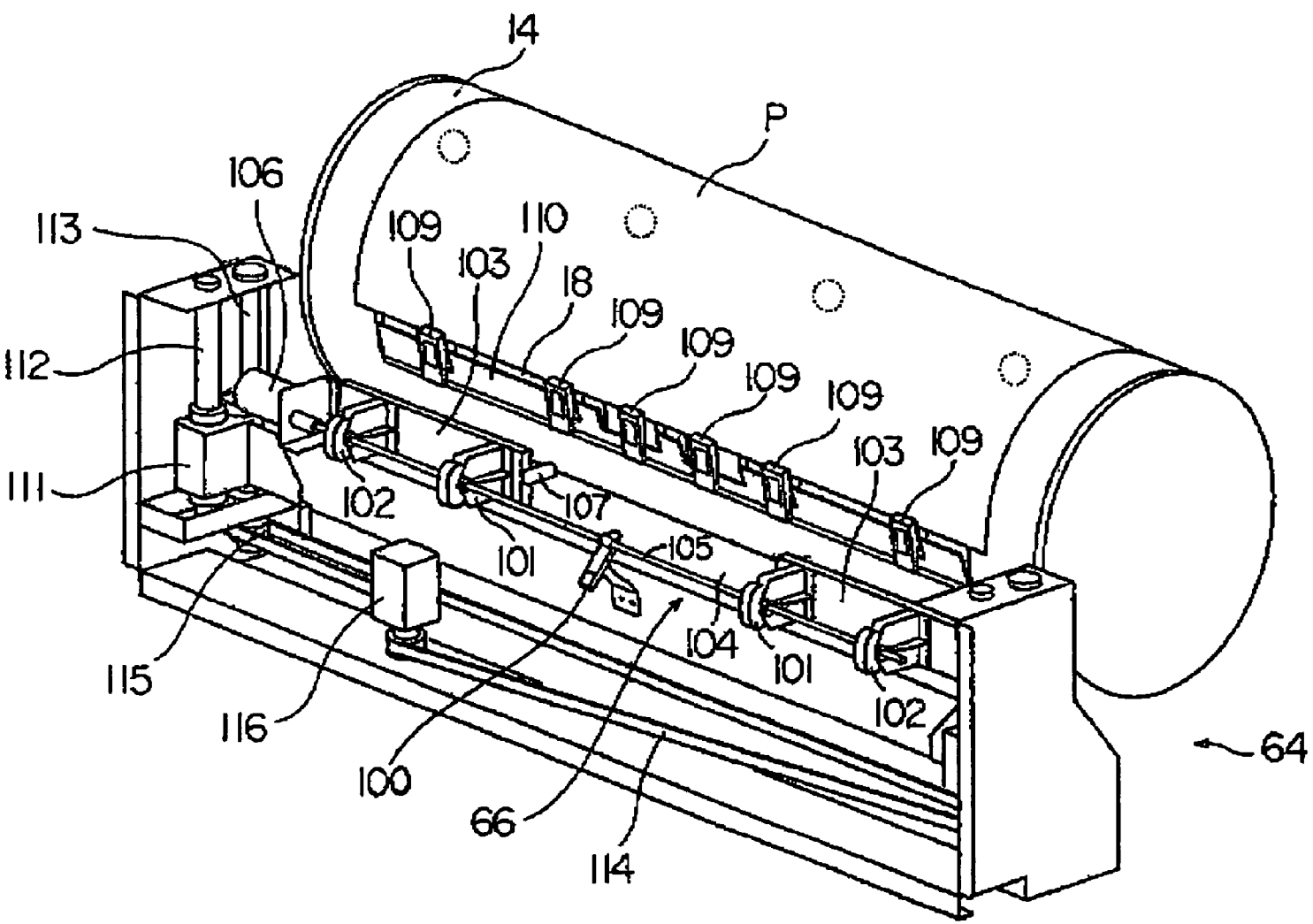
FIG. 2 is a perspective view showing a punch mechanism along with a recording drum.
Figure 3:
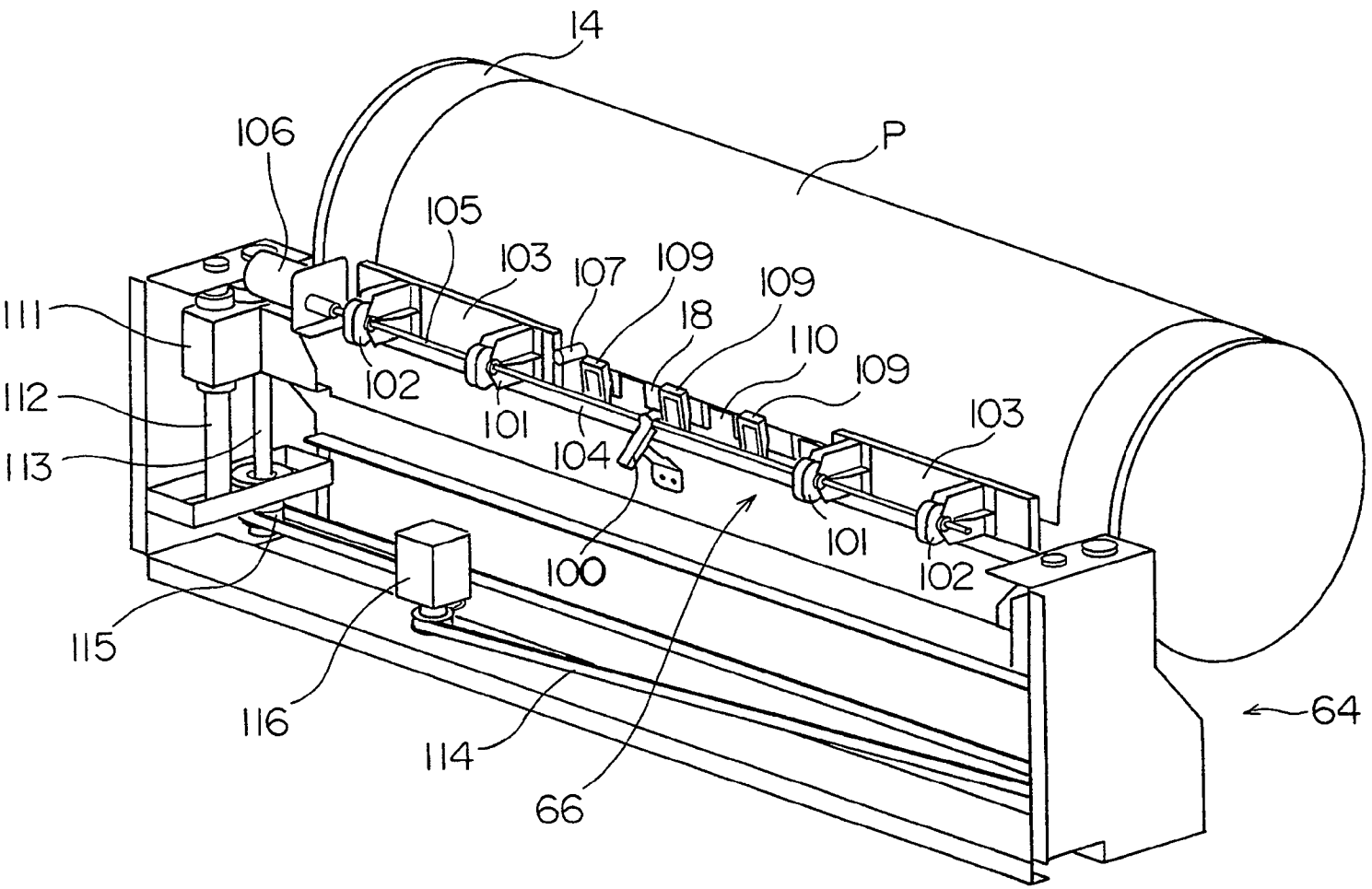
FIG. 3 is a perspective view showing the punch mechanism along with the recording drum.
Figure 4:
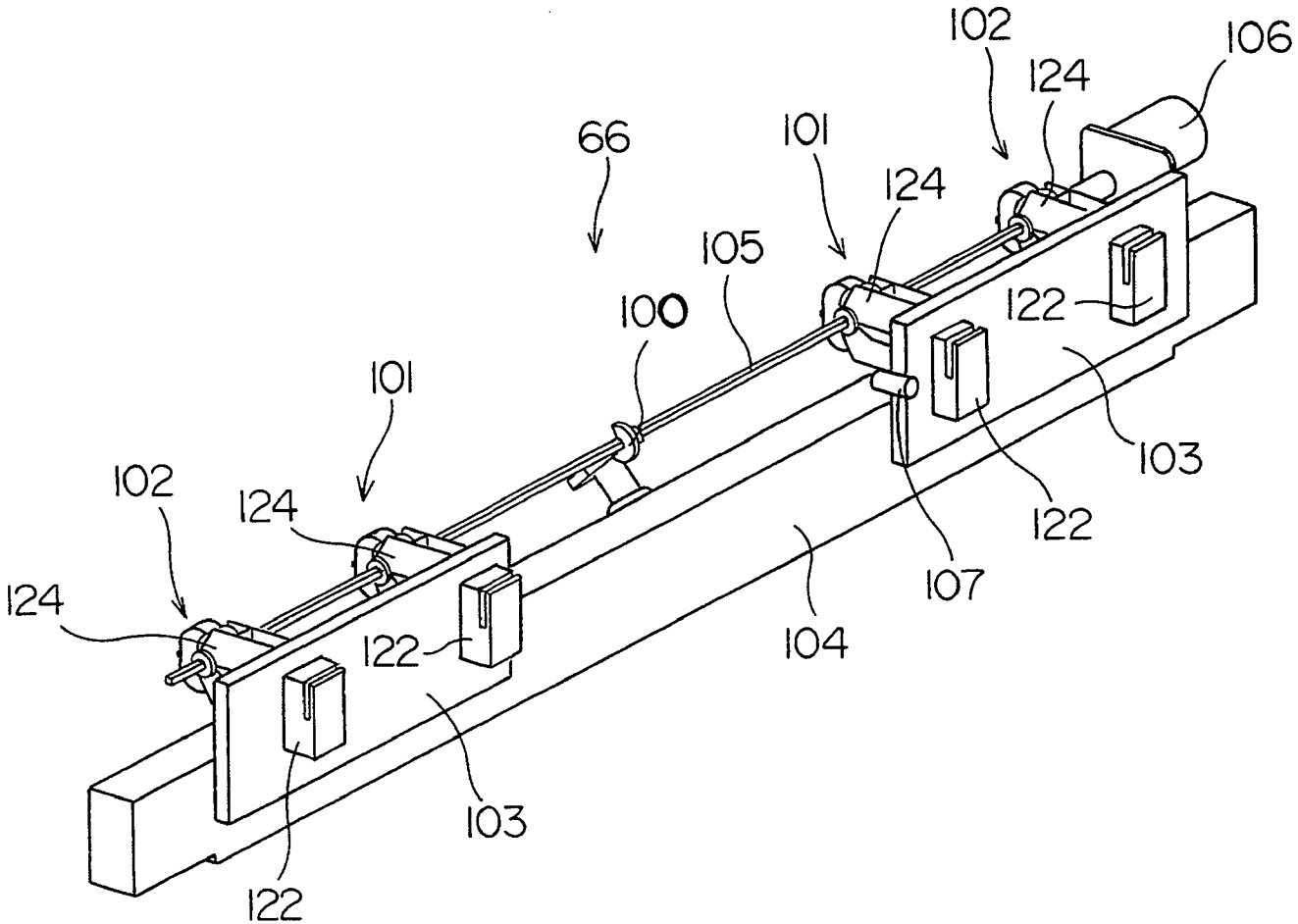
FIG. 4 is a perspective view seen from an opposite side of the punch unit.

Next, the construction of the punch mechanism 64 constituting a characterizing feature of this invention will be described. FIGS. 2 and 3 are perspective views showing the punch mechanism 64 along with the recording drum 14. FIG. 4 is a perspective view showing a punch unit 66 in the punch mechanism 64 seen in a direction reversed from FIGS. 2 and 3.

This punch mechanism 64 includes the punch unit 66, and a moving mechanism for vertically moving the punch unit 66 between a standby position shown in FIG. 2 and a punching position shown in FIG. 3.

The punch unit 66 has a pair of punch blocks 101 for forming positioning bores in a recording material P of relatively small size, and a pair of punch blocks 102 for forming positioning bores in a recording material P of relatively large size. These punch blocks 101 and 102 are supported by an arm 104 through support plates 103. The arm 104 has a motor 106 for rotating a drive rod 105 to drive the punch blocks 101 and 102, a detector 100 for detecting rotation angles of the drive rod 105, and a sensor 107 for detecting the forward end of recording material P.

The moving mechanism includes support members 111 arranged at opposite ends of the arm 104, slide shafts 112 and ball screws 113 connected to the support members 111, and a pulse motor 116 for driving the ball screws 113 through a synchronous belt 114 and synchronous pulleys 115. With this moving mechanism, the ball screws 113 rotated by drive of the pulse motor 116 vertically move the punch unit 66 between the standby position shown in FIG. 2 and the punching position shown in FIG. 3.

The punching position of the punch unit 66 is a position where the forward end of the recording material P mounted peripherally of the recording drum 14 is inserted into slits 121 formed in dies 122 of the respective punch blocks 101 and 102 as described hereinafter. The standby position is a position where the punch unit 66 is lowered from the punching position away from the recording drum 14.

Figure 15:
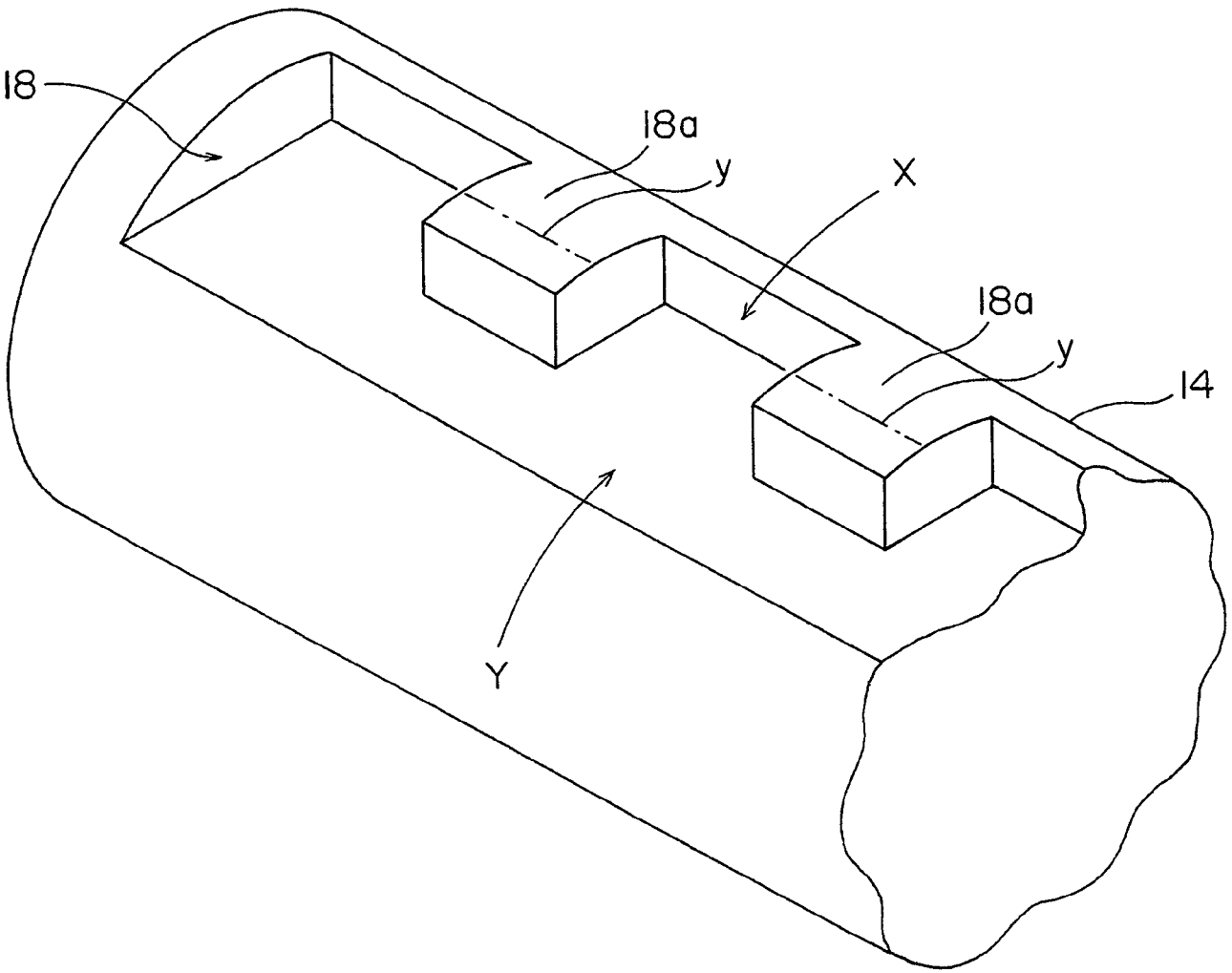
FIG. 15 is an enlarged perspective view of a portion of the recording drums.

FIG. 15 is an enlarged perspective view of a portion of the recording drum 14 for illustrating a recess 18. For simplicity of illustration, certain components such as forward end clamps 109 are omitted from this figure.

As shown in FIG. 15, the recess 18 is a groove of airfoil section having a depth increasing gradually in a circumferential direction, and elongated axially of the recording drum 14. On the bottom of the recess 18, a plurality of projections 18*a* are formed at intervals axially of the recording drum 14 for arranging the forward end clamps 109. The surfaces of projections 18*a* have the same curvature as the peripheral surface of the recording drum 14. The recording material P is fed in the X-direction in FIG. 15, with the forward end stopping in a position on the projections 18*a* indicated by an alternate long and short dash line y. The recording material P is supported in an intermediate portion thereof by the plurality of projections 18*a*, and is fixed in this state by the forward end clamps 109 described hereinafter. Consequently, the forward end of the recording material P does not sink into the recess 18. That is, the forward end of the recording material P is supported linearly over the recess 18.

Punches 123 of the punch blocks 101 and 102 are retractably movable in the Y-direction in FIG. 15 into cutout portions arranged laterally of the projections 18*a*.

As shown in FIGS. 2 and 3, the recording drum 14 has six forward end clamps 109 for clamping the forward end of the recording material P disposed over the recess 18 in the recording drum 14. The forward end clamps 109 are opened and closed by the opening and closing mechanism 61 noted hereinbefore. A windshield bar 110 is disposed adjacent these forward end clamps 109. When the recording drum 14 rotates at high speed with the forward end of the recording material P clamped by the forward end clamps 109, airflows would enter through a space between the recording material P and the recording drum 65. The windshield bar 110 is provided to block such incoming airflows generating a force to separate the recording material P from the peripheral surface of the recording drum 14.

The forward end clamps 109 are hinge-shaped elements each having an end for pressing and fixing the recording material P. This end is biased toward the peripheral surface of the recording drum 65 by a spring not shown. The forward end clamps 109 are opened when the other ends are pressed by the opening and closing mechanism 61, to be ready for receiving the forward end of the recording material P fed by the recording material transport device 13.

As shown in FIG. 2, the windshield bar 110 is a plate-like element elongated axially of the recording drum 14 with a plurality of (e.g. six) cutout portions formed in positions corresponding to the forward end clamps 109. As shown in FIG. 12, the windshield bar 110 is secured to the bottom of the recess 18 to have an open/close end thereof facing the same direction as the ends of the forward end clamps 109 that press the recording material P. The windshield bar 110 is biased by a spring 110*a* in a direction to open the open/close end thereof. The windshield bar 110, with the open/close end thereof opened, prevents airflows entering between the forward end of the recording material P and the recording drum 65.

Figure 5:
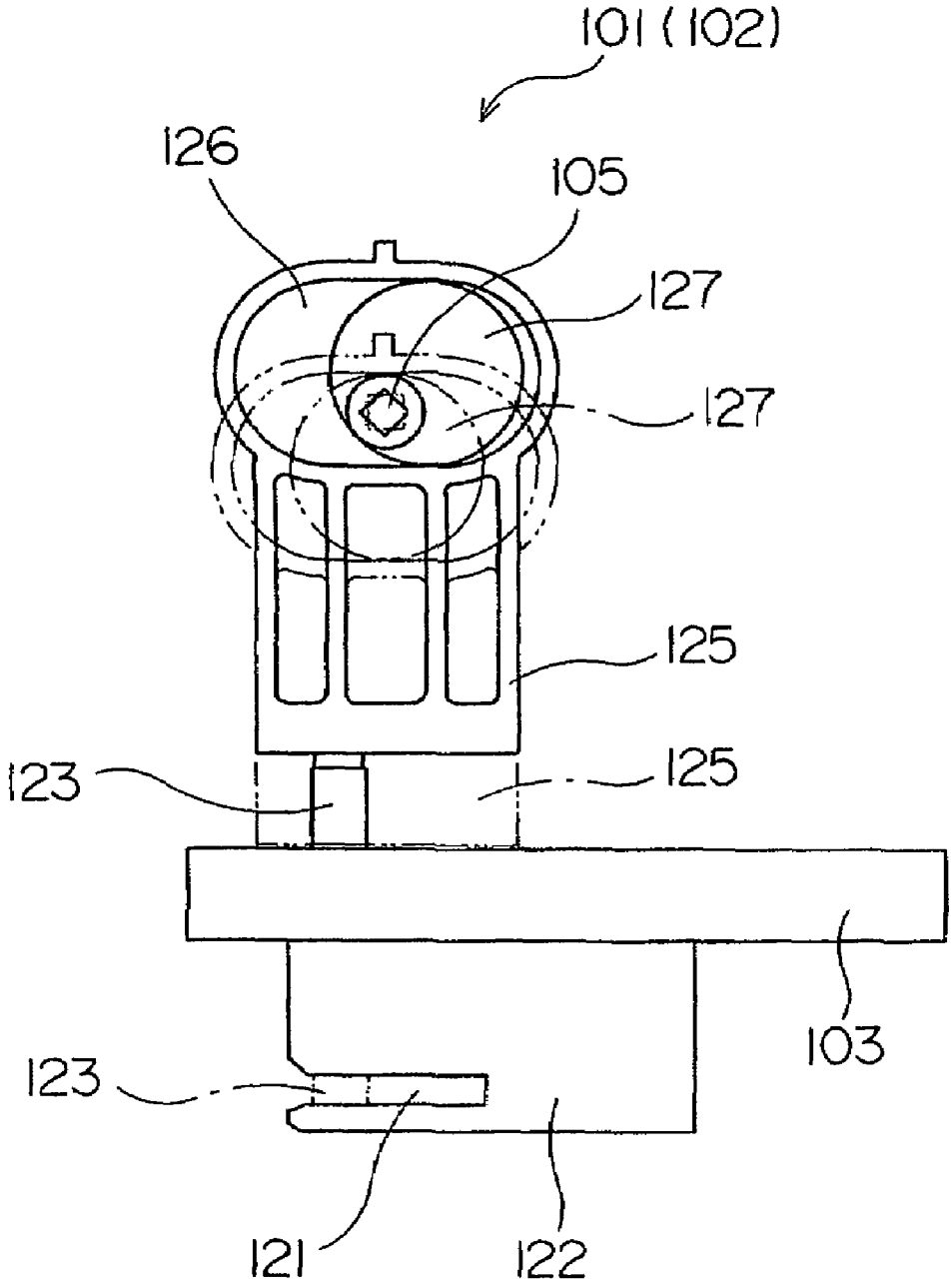
FIG. 5 is an explanatory view showing a principal portion of a punch block.

The construction of the punch blocks 101 and 102 in the above punch unit 66 will be described next. FIG. 5 is an explanatory view showing a principal part of the punch block 101 (102). FIGS. 6 and 7 are explanatory views showing an operation of the punch blocks 101 and 102 for forming positioning bores.

Each of the punch blocks 101 and 102 has a die 122 defining a slit 121, and a punch 123 movable through the die 122 for punching a positioning bore in the recording material P inserted into the slit 121. The punch 123 is connected to a moving member 125, movable back and forth through a case 124 (FIG. 4). The moving member 125 has an elliptical opening 126 formed at an end thereof.

The opening 126 has a cam 127 mounted therein and connected to the drive rod 105 described hereinbefore. When the drive rod 105 is rotated by the drive of the motor 106 shown in FIG. 4, the cam 127 presses on the inner wall of the opening 126. As a result, the moving member 125 moves through the case 124. When the moving member 125 moves from a position shown in solid lines to a position shown in two-dot chain lines in FIG. 5, the punch 123 moves in the die 122 to a position for punching a positioning bore in the recording material inserted into the slit 121.

Figure 6A:
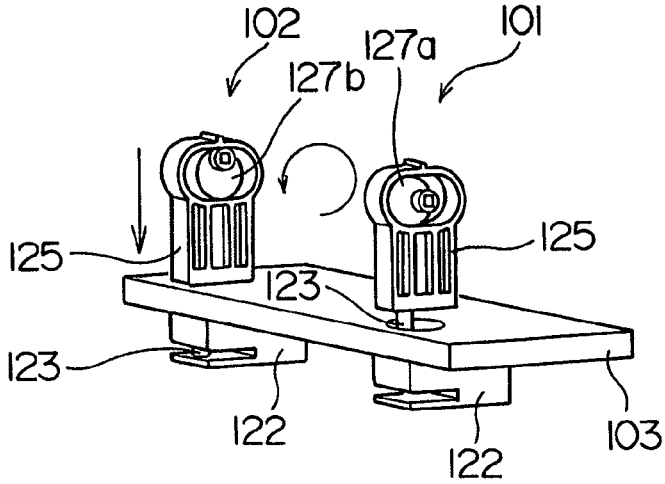
FIG. 6A is an explanatory view showing a punch of a punch block moving to a position for forming a positioning bore in a recording material.
Figure 6B:
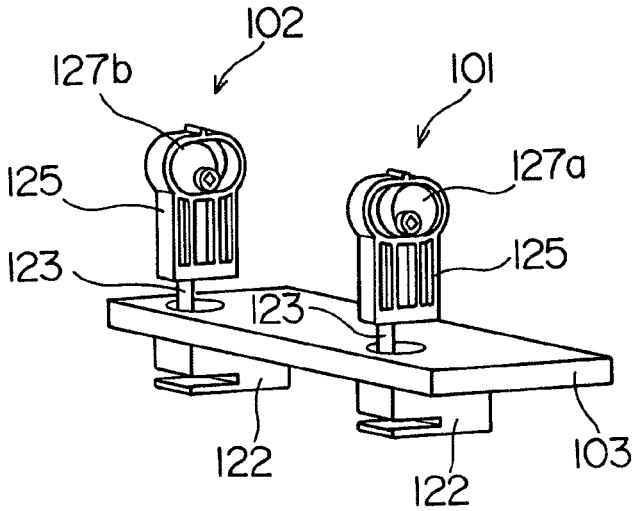
FIG. 6B is an explanatory view showing punches of punch blocks on standby.
Figure 6C:
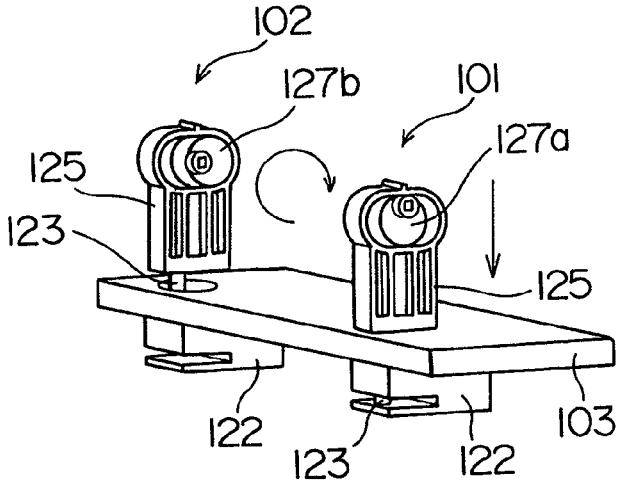
FIG. 6C is an explanatory view showing a punch of the other punch block moving to a position for forming a positioning bore in the recording material.
Figure 7A:
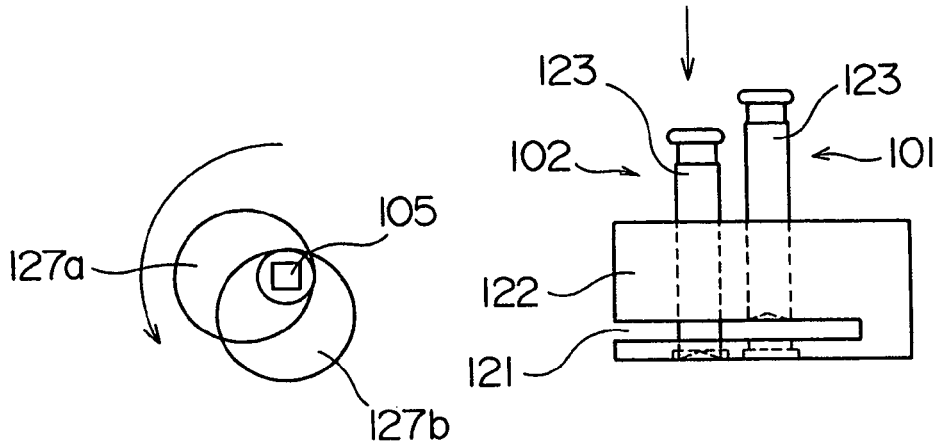
FIG. 7A is an explanatory view showing a punch of a punch block moving to the position for forming a positioning bore in the recording material.
Figure 7B:
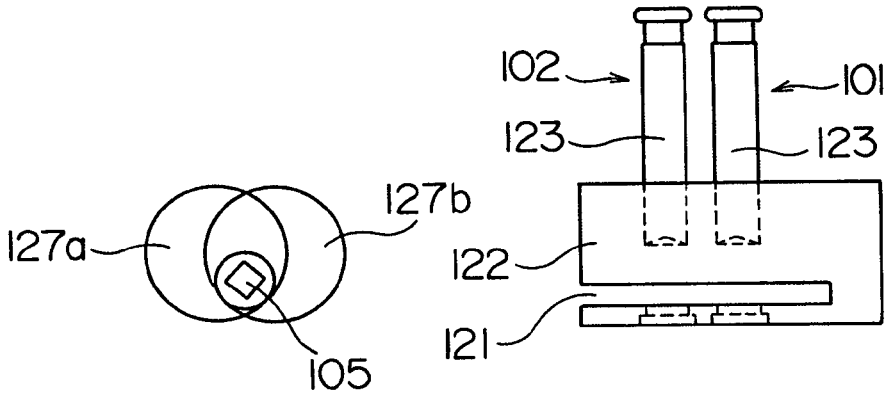
FIG. 7B is an explanatory view showing the punches of the punch blocks on standby.
Figure 7C:
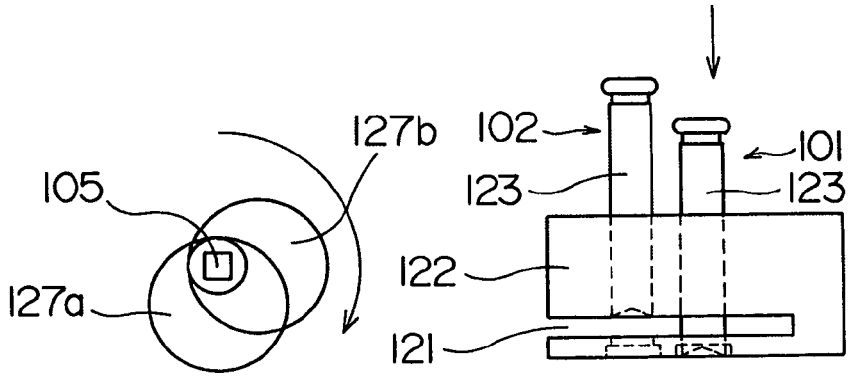
FIG. 7C is an explanatory view showing the punch of the other punch block moving to the position for forming a positioning bore in the recording material.

Cams 127*a* in the pair of punch blocks 101 and cams 127*b* in the pair of punch blocks 102 are connected in different phases to the drive rod 105. Thus, when the drive rod 125 rotates counterclockwise from a standby state shown in FIGS. 6B and 7B, the punch 123 in each punch block 102 moves to the position for punching a positioning bore in the recording material as shown in FIGS. 6A and 7A. When the drive rod 125 rotates clockwise from the standby state shown in FIGS. 6B and 7B, the punch 123 in each punch block 101 moves to the position for punching a positioning bore in the recording material as shown in FIGS. 6C and 7C.

Where such a construction is employed, positioning bores may be formed with different distances therebetween by changing the directions of rotation of the drive rod 125. Thus, even where positioning bores need to be formed with different distances therebetween, the construction of the punch unit 66 may be made simple.

Figure 8:
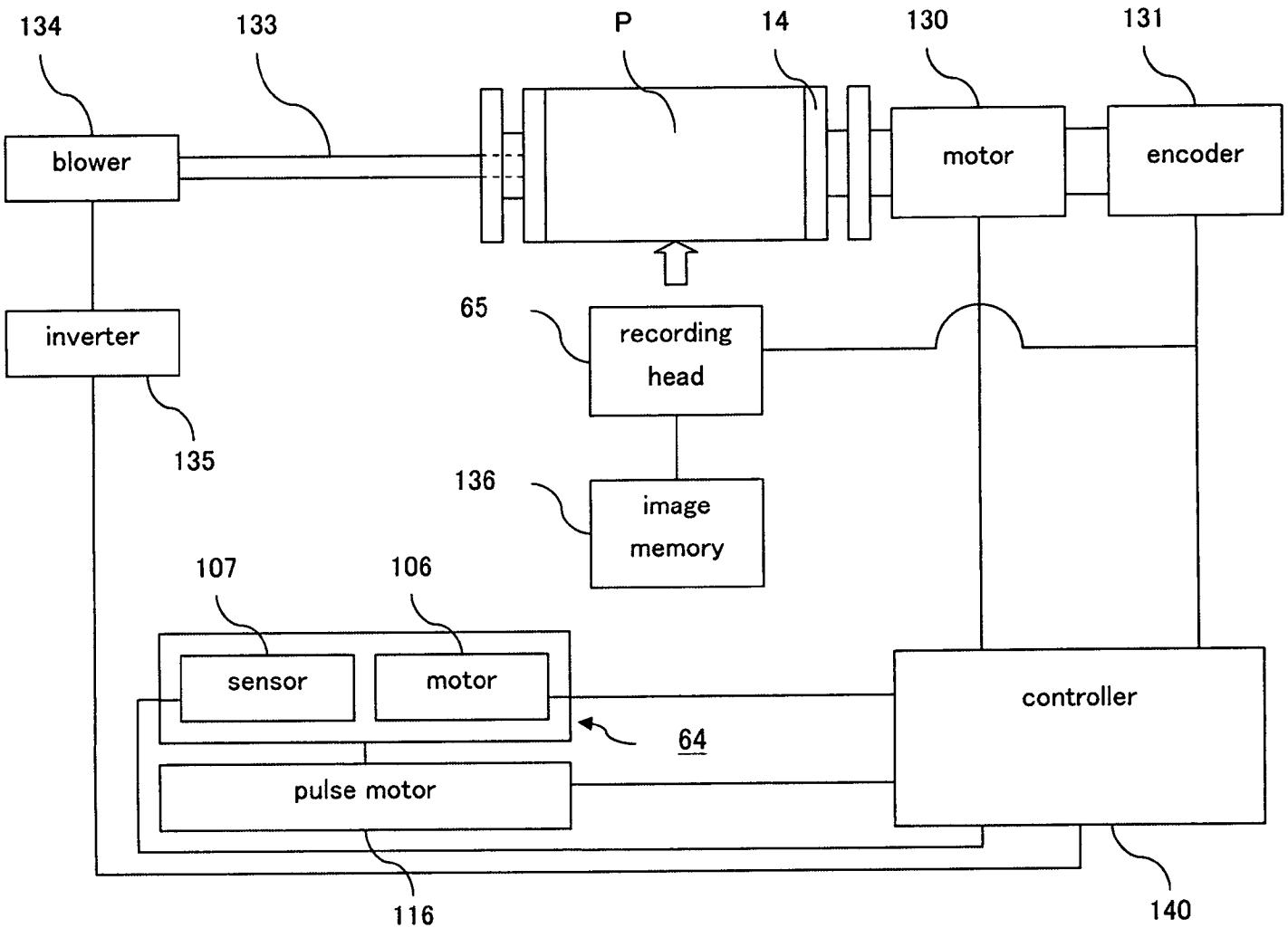
FIG. 8 is a block diagram showing a principal electrical structure of the image recording apparatus.

A principal electrical structure of the image recording apparatus according to this invention will be described next. FIG. 8 is a block diagram showing the principal electrical structure of the image recording apparatus.

The recording drum 14 for supporting the recording material P is connected to a motor 130. The encoder 131 noted hereinbefore is attached to the motor 130. The encoder 131 transmits primary scan position information indicating a rotation angle of the recording drum 14 to a controller 140. Based on the primary scan position information received from the encoder 131 and image data received from an image memory 136, the recording head 65 emits modulated laser beams to the recording material P mounted peripherally of the recording drum 14. Further, the recording head 65 receives from the controller 140 data for changing an image recording start position described hereinafter.

The controller 140 is connected also to the motor 106 for rotating the drive rod 105 of the punch unit 66, the sensor 107 for detecting the forward end of the recording material P, and the pulse motor 116 for vertically moving the punch unit 66.

Though not shown, the recording drum 14 has a hollow configuration. The recording drum 14 has suction bores formed in the peripheral surface thereof and communicating with an inner space of the drum 14 for holding by suction the recording material P on the peripheral surface of the drum 14. The inner space of the recording drum 14 is connected through an air duct 133 to a blower 134 driven by an inverter 135. By drawing air from the duct 133 by action of the blower 134, the recording material P can be suction-supported on the peripheral surface of the recording drum 14.

This blower 134 is reversible by controlling the inverter 135 with a signal from the controller 140. As described hereinafter, when discharging the recording material P from the peripheral surface of the recording drum 14, the blower 134 is reversed to feed air into the inner space of the recording drum 14.

Figure 9:
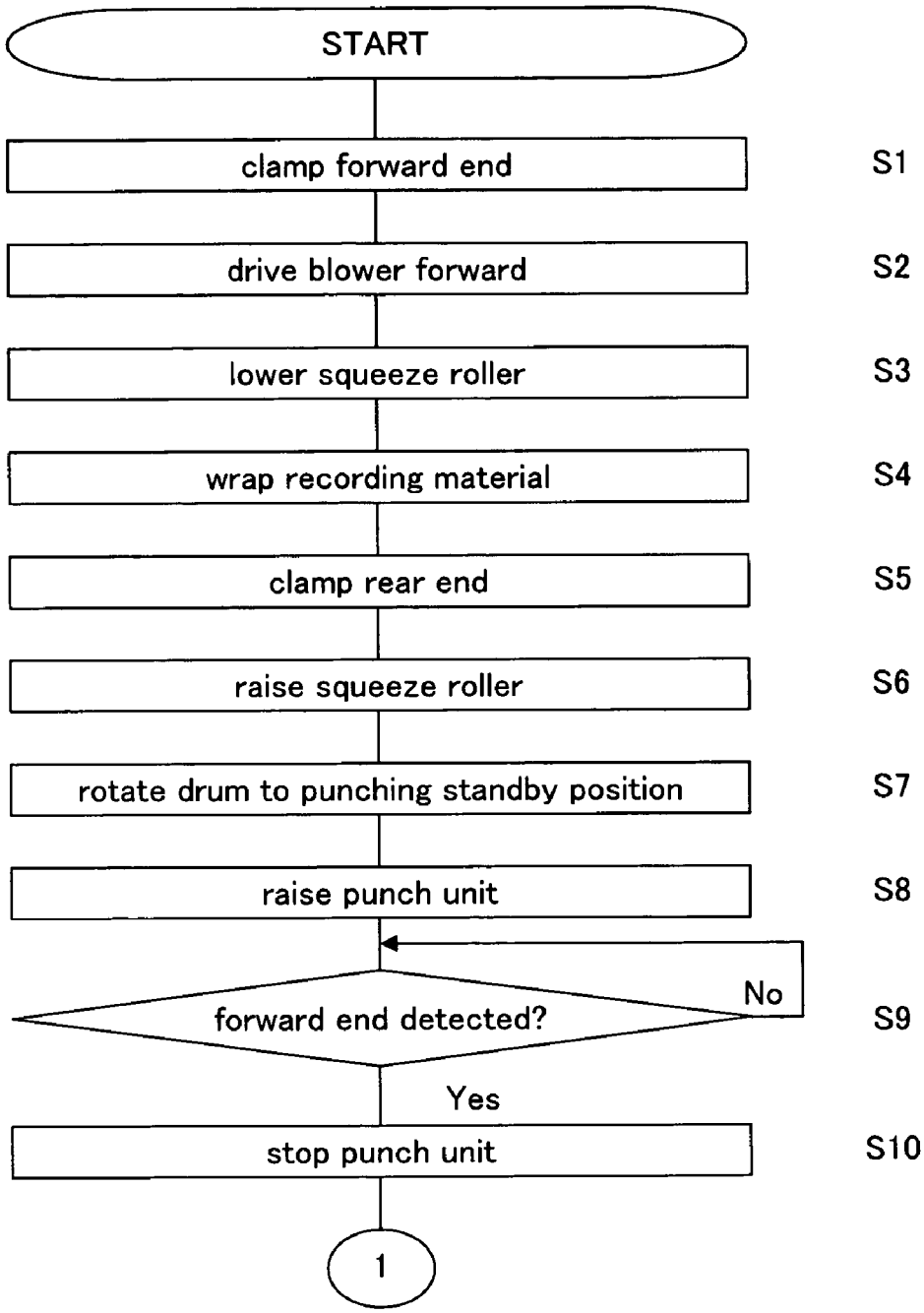
FIG. 9 is a flow chart of operations from attaching the recording material to the recording drum to discharging the recording material.
Figure 10:
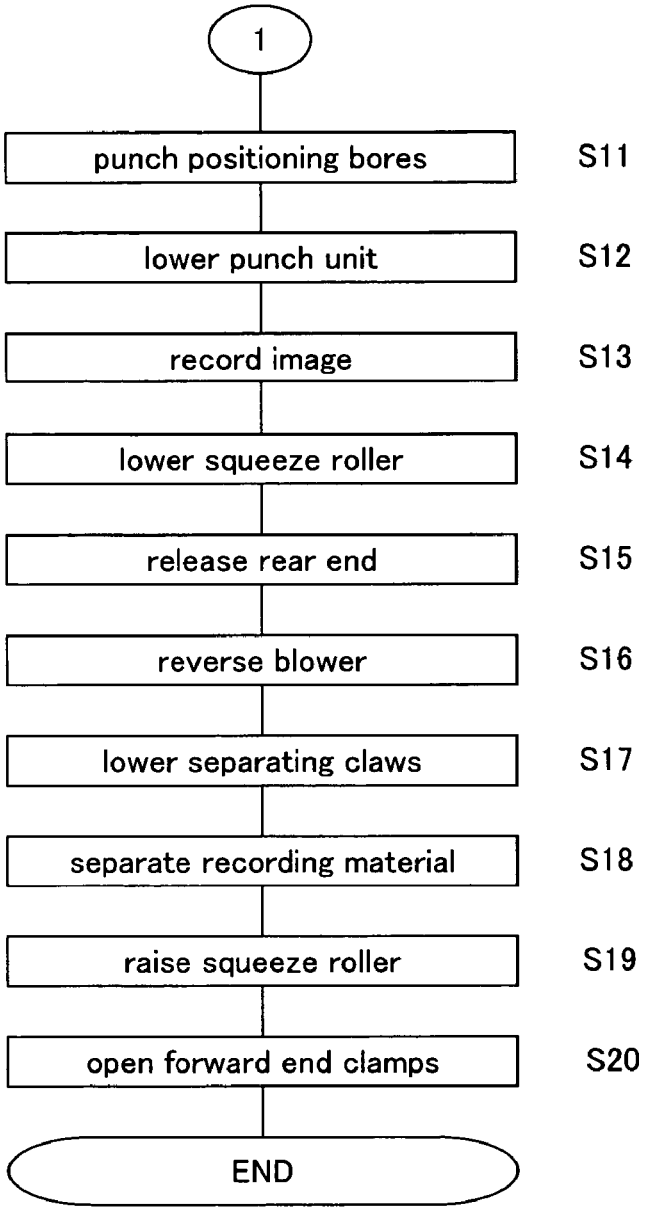
FIG. 10 is a flow chart of operations from attaching the recording material to the recording drum to discharging the recording material.

Next, operations of the above image recording apparatus from attaching the recording material P to the recording drum 14 to discharging the recording material P will be described. FIGS. 9 and 10 are flow charts of the operations from attaching the recording material P to the recording drum 14 to discharging the recording material P.

First, the forward end of the recording material P fed from the recording material transport device 13 in the position C in FIG. 1 is clamped to the peripheral surface of the recording drum 14 (step S1). This operation is performed by causing the opening and closing mechanism 61 shown in FIG. 1 to operate the forward end clamps 109 shown in FIGS. 2 and 3.

Next, the inverter 135 shown in FIG. 8 causes the blower 134 to rotate forward (step S2). Then, the squeeze roller 63 shown in FIG. 1 is lowered to the recording material P (step S3). The recording drum 14 is rotated at low speed counterclockwise in FIG. 1, to wrap the recording material P close around the peripheral surface of the recording drum 14 (step S4).

Next, the rear end of the recording material P is clamped (step S5). This operation is performed by causing the opening and closing mechanism 62 shown in FIG. 1 to attach the rear end clamps to the peripheral surface of the recording drum 14. After the rear end is clamped, the squeeze roller 63 is raised (Step S6).

Next, the recording drum 14 is rotated to a punching standby position and stopped in this angular position (step S7). The controller 140 constantly supervises angular positions of the recording drum 14 based on the signals from the encoder 131, and can stop the recording drum 14 in an exact position relative to the punch unit 66. After the recording drum 14 is rotated to the punching standby position, a further rotation of the recording drum 14 may be mechanically prohibited by a braking mechanism.

Figure 11:
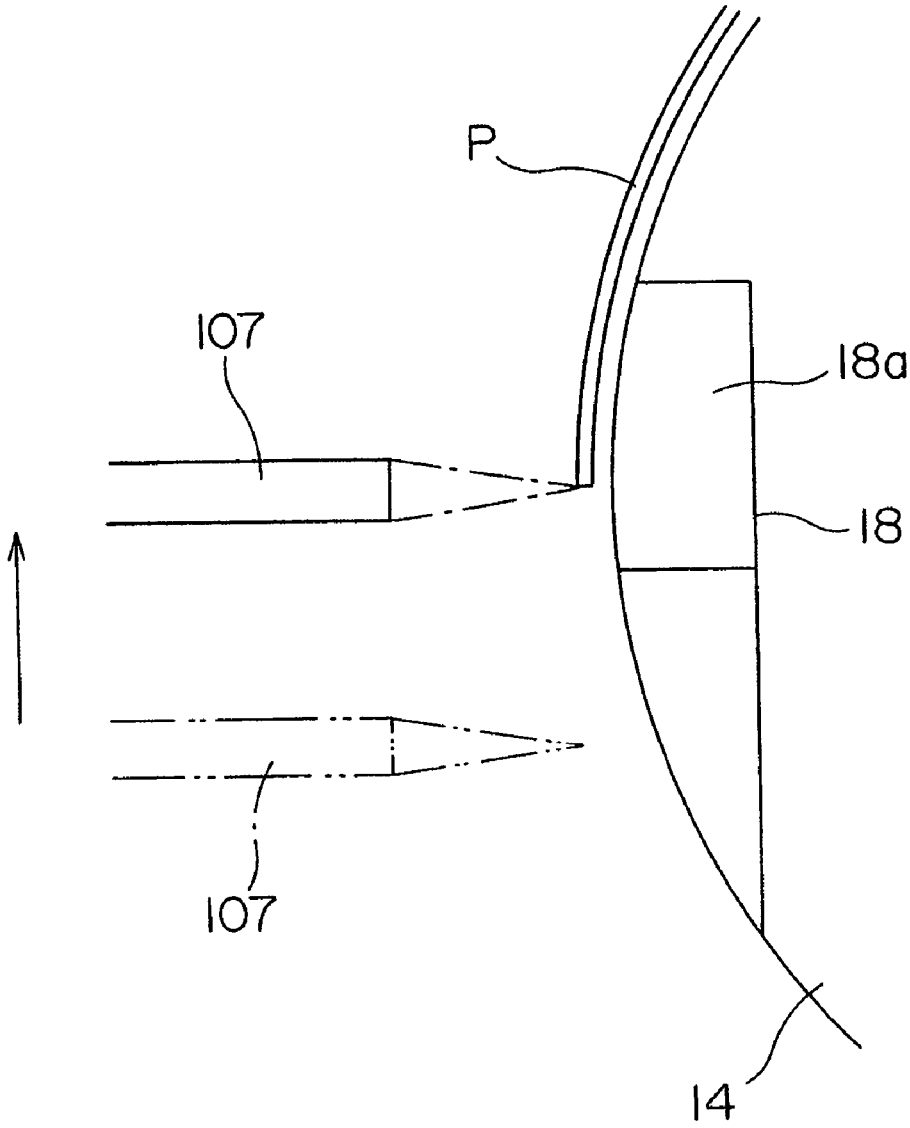
FIG. 11 is a schematic view showing an operation of a sensor for detecting a forward end of the recording material.

Next, the pulse motor 116 shown in FIGS. 2 and 3 is operated to raise the punch unit 66 (step S8). In time of ascent of the punch unit 66, as shown in FIG. 11, the sensor 107 attached to the punch unit 66 checks for the forward end of the recording material P. When the sensor 107 detects the forward end of the recording material P (step S9), the punch unit 66 is determined to lie in the punching position, and the ascent of the punch unit 66 is stopped (step S10). By detecting the forward end of the recording material P and stopping the ascent of the punch unit 66 in this way, the forward end of the recording material P and the punch unit 66 may be placed in a fixed positional relationship at all times.

It is not necessary to stop the ascent of the punch unit 66 as soon as the sensor 107 detects the forward end of the recording material P. The punch unit 66 may be stopped at a point of time when the punch unit 66 has been raised by a fixed amount after the sensor 107 detects the forward end of the recording material P. In this case also, the forward end of the recording material P and the punch unit 66 may be placed in a fixed positional relationship at all times.

Figure 12A:
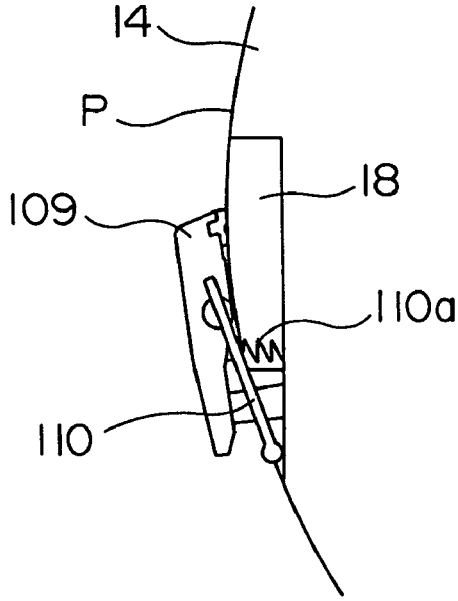
FIG. 12A is a schematic view showing a windshield bar disposed in a position adjacent the forward end of the recording material.
Figure 12B:
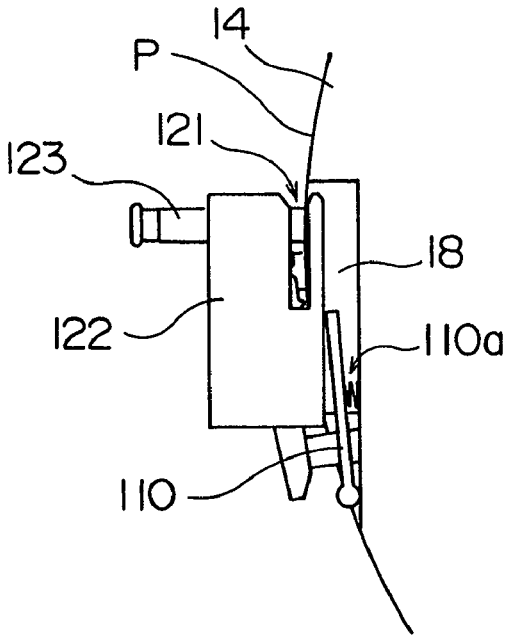
FIG. 12B is a schematic view showing the windshield bar retracted into a recess.

In an ordinary state, as shown in FIG. 12A, the windshield bar 110 noted hereinbefore is disposed in a position adjacent the forward end of the recording material P. However, where the punch unit 66 is moved to the punching position, as shown in FIG. 12B, the windshield bar 110 is pressed by the dies 122 into the recess 18. When the punch unit 66 is moved to the standby position, the windshield bar 110 returns to the position shown in FIG. 12A.

In this state, the motor 106 of the punch unit 66 is operated to rotate the drive rod 105 in either direction, to move the punches 123 in the dies 122 of the punch blocks 101 or 102, thereby punching positioning bores in the recording material P inserted into the slits 121 (step S11). Upon completion of the punching operation, the punch unit 66 is lowered to the standby position (step S12).

Then, the recording drum 14 is rotated at high speed for recording an image (step S13). In time of recording the image, an adjustment is made of an image recording start position in the primary scanning direction based on the position of the forward end of the recording material P detected by the sensor 107.

Figure 13:
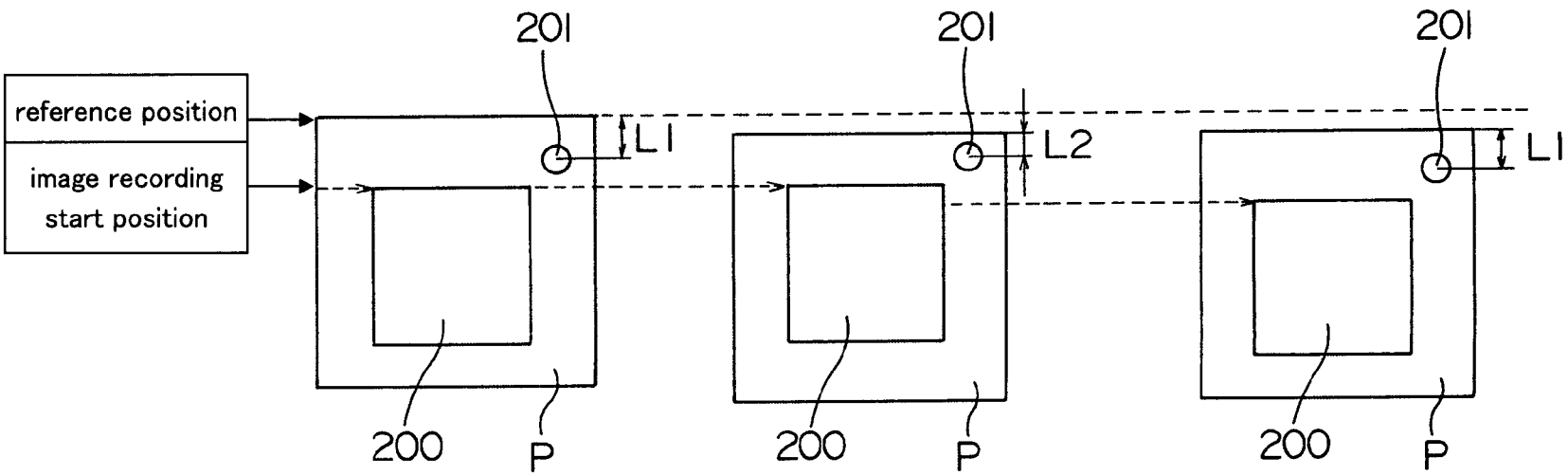
FIG. 13 is an explanatory view showing positioning bores and image recording start positions.

This aspect will be described with reference to FIG. 13. FIG. 13 is an explanatory view showing positions of a positioning bore 201 and image recording start positions.

When attaching the recording material P to the recording drum 14, as shown at the left end of FIG. 13, the forward end of the recording material P may coincide with a reference position on the peripheral surface of the recording drum 14. Then, the recording start position for image 200 coincides with a predetermined position, and an plate edge distance (i.e. a distance from the forward end of the recording material P to the center of the positioning bore 201) is L1 at this time.

On the other hand, when the forward end of the recording material P attached to the recording drum 14 is displaced from the reference position, as shown in the middle of FIG. 13, the plate edge distance is changed from L1 to L2. This displacement presents no problem to printing itself since the positional relationship between the positioning bore 201 and the image 200 remains unchanged. However, the difference in the plate edge distance may pose a problem for a subsequent process.

The embodiment described above constantly secures the plate edge distance L1 by stopping the ascent of the punch unit 66 by the pulse motor 116 when the sensor 107 detects the forward end of the recording material P. As shown at the right end of FIG. 13, the image recording start position in the primary scanning direction is adjusted according to the position of the forward end of the recording material P detected by the sensor 107, thereby fixing the positional relationship between the positioning bore 201 and the image 200.

Referring to FIG. 10 again, when the image recording operation is completed, the squeeze roller 63 is lowered to the recording material P (step S14). Then, the clamped rear end of the recording material P is released (step S15). The blower 134 is reversed by action of the inverter 135 shown in FIG. 8, to feed air into the inner space of the recording drum 14 through the duct 133 (step S16). This will facilitate separation of the recording material P from the peripheral surface of the recording drum 14.

Figure 14:
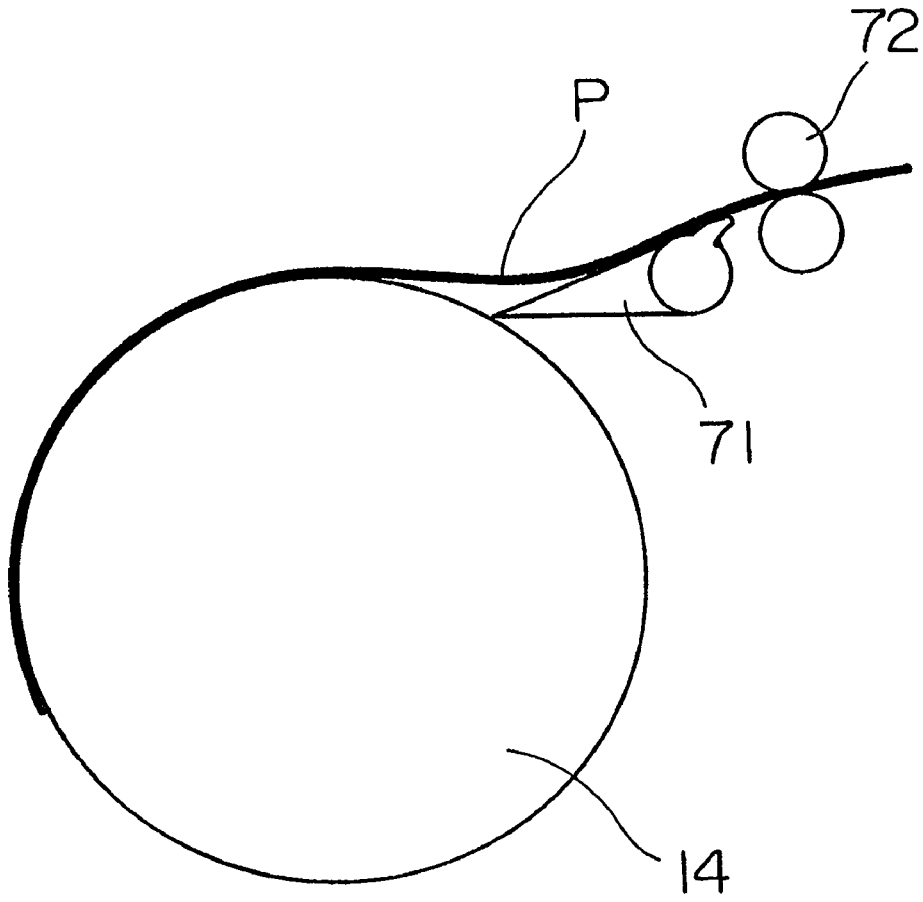
FIG. 14 is an explanatory view showing an operation for separating the recording material.

In this state, the separating claws 71 are lowered to a position for contacting the surface of the recording drum 14 (step S17). Then, the recording drum 14 is rotated clockwise in FIG. 1, to separate the recording material P from the peripheral surface of the recording drum 14 (step S18). In this state, as shown in FIG. 14, the recording material P is guided at the forward end thereof by the separating claws 71 to one of the transport roller pairs 72. Then, the squeeze roller 63 is raised (step S19), the clamped forward end of the recording material P is released (step S20), and the recording material P is transported toward the discharge mechanism 17.

In the above embodiment, the recording material P is held on the peripheral surface of the recording drum 14 by the combination of clamps and vacuum suction. The recording material P may be held in place only by the clamps or by vacuum suction of the blower 134. Further, this invention may be implemented also where the recording material P is held on the peripheral surface of the recording drum 14 by an attaching mechanism other than the clamps or vacuum suction.

In the above embodiment, the sensor 107 is attached to the punch unit 66, the punch unit 66 is raised by the pulse motor 116 toward the recording drum 65 in the punching standby position, and when the sensor 107 detects the forward end of the recording material P, the ascent of the punch unit 66 is stopped. Then, the image recording start position is adjusted according to the amount of ascent from the standby position (initial position) of the punch unit 66. By performing a punching operation in this way, the positioning bore and recorded image may be maintained in a desired positional relationship while securing a fixed plate edge distance.

Figure 16:
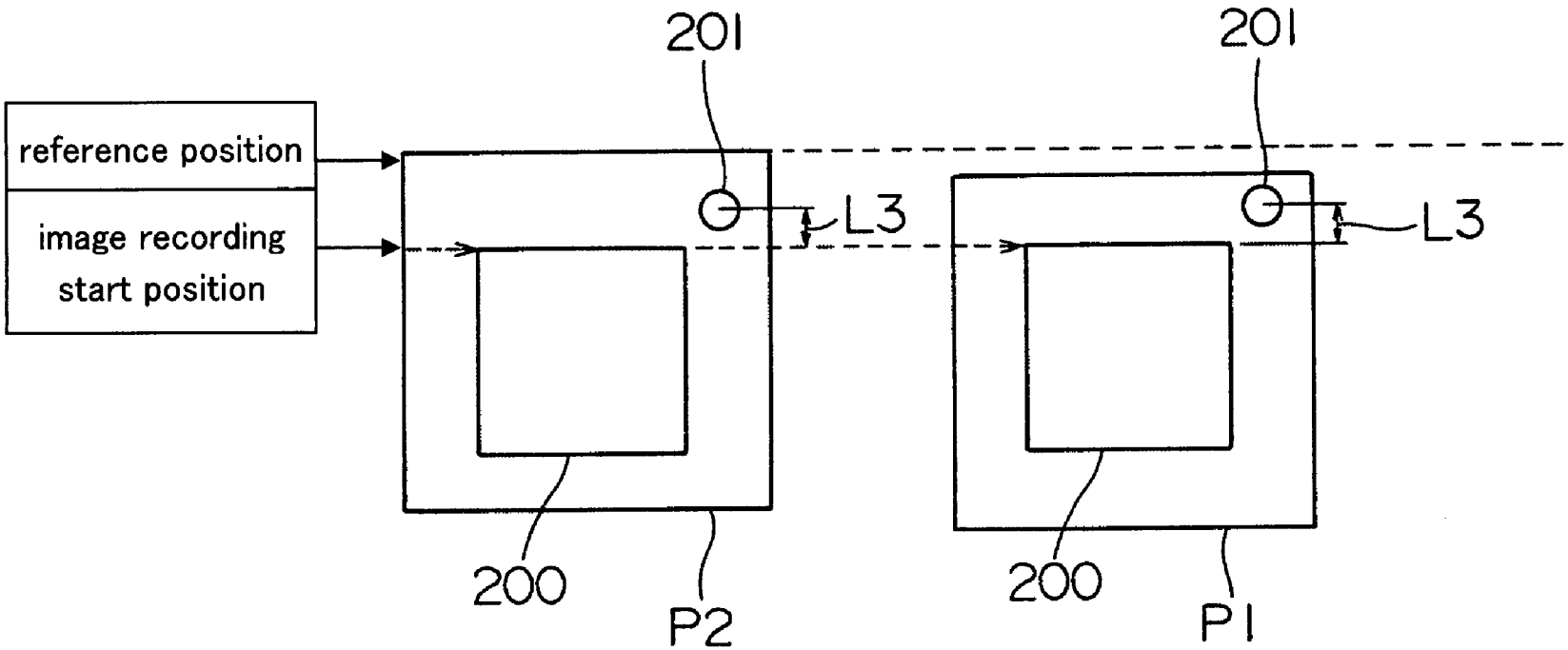
FIG. 16 is an explanatory view showing positioning bores and image recording start positions.

However, where a precise plate edge distance is not required, the above punching process is not absolutely necessary. That is, the sensor 107 is dispensable. A process carried out in this case will be described with reference to the flow charts of FIGS. 9 and 10. In this case, the punch unit 66 is raised a fixed amount in step S8 of FIG. 9. The detection of the forward end of the recording material P by the sensor 107 (step S9) is not carried out. Since the recording drum 14 is already located in the exact punching standby position in step S7, positioning bores may be formed in a fixed position relative to the peripheral surface of the recording drum 14, without the detection of the forward end of the recording material P, only by setting a fixed amount of ascent of the punch unit 66.

Where the recording material P is a soft material such as a printing plate with a polyester base, for example, as shown on the right side in FIG. 16, the forward end of the recording material P1 may be fixed as displaced from the reference position on the peripheral surface of the recording drum 14. Even in this case, the punch unit 66 may be raised by the same amount as where the recording material P2 is fixed to the reference position (in the left side in FIG. 16), whereby the same positional relationship between the positioning bore 201 and recorded image 200 is secured for the two recording materials P1 and P2. In the case shown in FIG. 16, the displacement circumferentially of the recording drum 14 between the punch bore 201 and the upper right end of the recorded image is L3 for both recording materials P1 and P2.

In the foregoing embodiment, the sensor 107 is used for correcting the recording start position and punching position for the recording material P. The sensor 107 may be used to perform error handling such as giving a warning to the operator after detecting a displacement from the reference position of the recording material P attached. In this case, whether a displacement from the reference position of the recording material P as fixed is in a permissible range or not is determined from whether an amount of ascent from the standby position of the punch unit 66 until the sensor 107 detects the forward end of the recording material P is within a predetermined range or not. When the amount of ascent is outside the above predetermined range, an error process is carried out by displaying an error message or discharging the recording material P fixed to the recording drum 14 from the apparatus without performing an image recording operation.

In the foregoing embodiment, a displacement of the recording material P in the primary scanning direction is detected. A displacement of the recording material P in the secondary scanning direction may be detected. In this case, the punch unit 66 is moved in the secondary scanning direction, and the image recording start position of the recording head 65 also is moved in the secondary scanning direction.

Further, an amount of inclination of the recording material P may be detected by a plurality of sensors 107 attached at different heights to the punch unit 66. In this case, the punching timing of each punch block 101 (102) forming the pair of punch blocks 101 (102) is varied from that of the other. That is, after one of the two punch blocks 101 (102) punches a bore, the punch unit 66 is raised by an amount corresponding to the above amount of inclination, and is moved in the secondary scanning direction. Then, the other punch block 101 (102) punches a bore. As a result, a straight line linking the pair of positioning bores 201 formed by the pair of punch blocks 101 (102) runs parallel to the forward end of the recording material P. The image data stored in the image memory 136 is rotated, thereby to rotate an image recorded by the recording head 65 on the recording material P.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2003-304288 filed in the Japanese Patent Office on Aug. 28, 2003, the entire disclosure of which is incorporated herein by reference.

What is claimed is:

1. An image recording apparatus comprising:

a recording drum having a peripheral surface defining a recess extending axially of the drum;

an attaching mechanism for attaching a recording material to the peripheral surface of said recording drum, with a forward end of said recording material located over said recess;

a rotating mechanism for rotating said recording drum;

a recording head for recording an image on said recording material by moving axially of said recording drum synchronously with rotation of said recording drum, and emitting light beams to said recording material mounted peripherally of said recording drum;

a punch unit having a die defining a slit, and a punch movable inside said die for punching a positioning bore in the recording material inserted into said slit; and a moving mechanism for moving said punch unit between a standby position separated from said recording drum, and a punching position where the forward end of the recording material mounted peripherally of said recording drum is inserted into the slit formed in said die.

2. An image recording apparatus as defined in claim 1, further comprising a sensor for detecting a position of the forward end of the recording material mounted peripherally of said recording drum.

3. An image recording apparatus as defined in claim 2, further comprising: the peripheral surface of said recording drum is formed with suction bores, said suction bores are connected to an exhaust mechanism through an air duct for drawing air through said air duct, thereby holding said recording material on the peripheral surface of said recording drum by suction; wherein, when discharging said recording material from the peripheral surface of said recording drum, said exhaust mechanism is reversed to feed air into said air duct.

4. An image recording apparatus as defined in claim 3, further comprising a claw mechanism for separating said recording material from the peripheral surface of said recording drum when discharging said recording material from the peripheral surface of said recording drum.

5. An image recording apparatus as defined in claim 1, further comprising:

a sensor for detecting a position of the forward end of the recording material mounted peripherally of said recording drum; and controller for controlling an amount of movement of said punch unit caused by said moving mechanism according to the position of the forward end of the recording material detected by said sensor, and adjusting an image recording start position of said recording head based on the position of the forward end of the recording material detected by said sensor.

6. An image recording apparatus as defined in claim 5, wherein said sensor is attached to said punch unit for detecting the position of the forward end of said recording material during movement of said punch unit.

7. An image recording apparatus as defined in claim 6, further comprising:

the peripheral surface of said recording drum is formed with suction bores, said suction bores are connected to an exhaust mechanism through an air duct for drawing air through said air duct, thereby holding said recording material on the peripheral surface of said recording drum by suction;

wherein, when discharging said recording material from the peripheral surface of said recording drum, said exhaust mechanism is reversed to feed air into said air duct.

8. An image recording apparatus as defined in claim 7, further comprising a claw mechanism for separating said recording material from the peripheral surface of said recording drum when discharging said recording material from the peripheral surface of said recording drum.

9. An image recording apparatus as defined in claim 5, further comprising:

the peripheral surface of said recording drum is formed with suction bores, said suction bores are connected to an exhaust mechanism through an air duct for drawing air through said air duct, thereby holding said recording material on the peripheral surface of said recording drum by suction;

wherein, when discharging said recording material from the peripheral surface of said recording drum, said exhaust mechanism is reversed to feed air into said air duct.

10. An image recording apparatus as defined in claim 9, further comprising a claw mechanism for separating said recording material from the peripheral surface of said recording drum when discharging said recording material from the peripheral surface of said recording drum.

11. An image recording apparatus as defined in claim 1, further comprising:

the peripheral surface of said recording drum is formed with suction bores, said suction bores are connected to an exhaust mechanism through an air duct for drawing air through said air duct, thereby holding said recording material on the peripheral surface of said recording drum by suction;

wherein, when discharging said recording material from the peripheral surface of said recording drum, said exhaust mechanism is reversed to feed air into said air duct.

12. An image recording apparatus as defined in claim 11, further comprising a claw mechanism for separating said recording material from the peripheral surface of said recording drum when discharging said recording material from the peripheral surface of said recording drum.

* * * * *